US006196275B1

(12) United States Patent
Yazawa et al.

(10) Patent No.: US 6,196,275 B1
(45) Date of Patent: Mar. 6, 2001

(54) DOUBLE CHAMBER AEROSOL CONTAINER AND MANUFACTURING METHOD THEREFOR

(75) Inventors: Iwao Yazawa, Higashimurayama; Toshiyuki Mitsui, Saitama-ken; Yukio Hachinohe, Sakado; Kazuhide Maeda, Higashimurayama, all of (JP)

(73) Assignee: Toyo Aerosol Industry Co., Ltd., Tokyo (JP)

( * ) Notice: Subject to any disclaimer, the term of this patent is extended or adjusted under 35 U.S.C. 154(b) by 0 days.

(21) Appl. No.: 09/216,724

(22) Filed: Dec. 21, 1998

(30) Foreign Application Priority Data

Jul. 14, 1998 (JP) ..... 10-199019

(51) Int. Cl.[7] ..... B65B 1/04

(52) U.S. Cl. ..... 141/3; 141/18; 141/20

(58) Field of Search ..... 222/95, 105, 386.5, 222/402.21, 402.23, 402.16, 402.13, 402.1; 141/3, 18, 20; 53/470, 266.1, 284.5

(56) References Cited

U.S. PATENT DOCUMENTS 3,225,967 * 12/1965 Heimgartner ..... 222/183
3,323,206 * 6/1967 Clark ..... 222/95
3,477,195 * 11/1969 Chambers ..... 141/20
3,662,926 * 5/1972 Umstead ..... 222/95
4,117,951 * 10/1978 Winckler ..... 222/95
4,150,522 * 4/1979 Burger ..... 53/470
4,211,344 * 7/1980 Stoody ..... 141/20
4,346,743 * 8/1982 Miller ..... 141/3
4,545,506 * 10/1985 Kadono ..... 222/95
5,248,063 * 9/1993 Abbott ..... 222/95
5,292,033 * 3/1994 Gueret ..... 222/95
5,505,039 * 4/1996 Maier ..... 53/470
6,092,566 * 7/2000 Yazawa et al. ..... 141/3

FOREIGN PATENT DOCUMENTS 2 089 897 6/1982 (GB) .

* cited by examiner

*Primary Examiner*—Steven O. Douglas
*Assistant Examiner*—Khoa Huynh
(74) *Attorney, Agent, or Firm*—Kanesaka & Takeuchi

(57) ABSTRACT

A double chamber aerosol container capable of filling contents in the container has a container cap that constitutes a liquid container with an inner sack to be temporarily fitted to a bead portion of an outer container while the inner sack is placed within the outer container. When the inner sack is placed with the outer container, the lower end of the inner sack is not in contact with the bottom of the interior of the outer container. The propellant is filled in the outer container upon forming a filling gap between the container cap and the bead portion, and then the container cap is surely clinched to the bead portion of the outer container.

4 Claims, 12 Drawing Sheets

DOUBLE CHAMBER AEROSOL CONTAINER AND MANUFACTURING METHOD THEREFOR

BACKGROUND OF THE INVENTION

1. Field of the Invention

This invention relates to a manufacturing method of a double chamber aerosol container used where contents, such as hair care products, cosmetics, antiperspirant-deodorants, other human body treatment products, insecticides, coating materials, cleaners, and other products for household, industrial materials, automobile goods, medicines, foods, and so on, are filled in an inner sack and where a propellant is filled in an outer container below a mountain cup or container cap.

2. Description of Related Art

Containers in which an inner sack filled with contents is mounted within an outer container and its volume is reducible according to reduction of the contents, have been known previously. In a double-chamber aerosol container, any direct contact between the propellant and the aerosol contents is not favorable.

In such a conventional double chamber aerosol container, the inner sack is attached inside the aerosol container where an edge of an orifice of the inner sack is engaged with a bead portion of the aerosol container and where the lower end of the inner sack is in contact with the bottom of the aerosol container. Contents only, without any propellant, are filled within the inner sack thus mounted.

After those contents are filled, the container cap is fitted inside the inner sack. After an upper opening of the inner sack is disposed at a space between the container cap and the bead portion of the aerosol container, the inner sack and the container cap are lifted upward to form a filling gap for the propellant between the outer periphery of the opening of the inner sack and the bead portion of the aerosol container, and thereby the propellant is filled within the aerosol container via the filling gap.

With this conventional method, however, the exterior is in air communication with the inside of the inner sack, because the contents are placed in the inner sack where the inner sack before the container cap is fitted is mounted within the container. If the contents are filled in such a circumstance, the contents may be spilt out when the container cap is fitted where the contents are filled up closely to the opening of the inner sack. On the other hand, if the contents are filled in a smaller amount, air may remain in the inner sack, and as a result, the contents may be oxidized or deteriorated.

Where the contents are agent type using an isopentane in a gel form or the like, the contents may be deteriorated due to contacts with the open air, or the isopentane may evaporate and generate bubbles where the temperature of the isopentane increases due to contacts with the open air, and those raise problems during such filling work. In case the open air contacts with the contents, such contacts are not favorable for medicines, cosmetics, foods, and so on for which prevention of contamination is strongly demanded.

The inner sack is in a state that the bottom of the inner sack is in contact with the inner surface of the bottom wall of the aerosol container to endure the weight of the contents when the contents are filled where the inner sack is mounted within the aerosol container. The bottom end of the inner sack thus contacts with the bottom of the aerosol container, so that the inner sack is advantageously stably disposed within the aerosol container in opposing to the weight of the contents.

In case the inner sack extends longer than the standard size due to manufacturing deviations of the inner sack or extensions of the material, however, the bead portion of the aerosol container is not properly in contact with the outer peripheral surface of the inner sack, thereby frequently rendering the inner sack inclined or projected upward. In such a case, sealing may become inadequate during clinching between the container cap and the bead portion at the final process. In case the inner sack is formed shorter than the standard size, the inner sack may accidentally drop in the aerosol container, and disadvantageous problems for the manufacturing process may happen frequently.

SUMMARY OF THE INVENTION

It is an object of the invention, from a viewpoint to solve the problems above, to provide a manufacturing method of an aerosol container capable of preventing contents from contacting with open air during filling of the contents to keep the contents away from deterioration or the like due to oxidation of the contents.

It is another object of the invention to provide a manufacturing method of an aerosol container not subject to overfilling or shortage of filling of the contents and, even if subject to shortage of filling, not subject to oxidation due to contacts between the open air and the contents.

It is yet another object of the invention to provide a manufacturing method of an aerosol container in which a bead portion of the aerosol container and an outer peripheral edge of an opening of a container cap and an inner sack are surely engaged with each other and in which such an engagement secures the container cap by clinching it so as not to create leaks and prevents the contents from deteriorated due to oxidation.

The foregoing objects are accomplished with an aerosol container including: an outer container having a hollow interior and a bead portion formed on a surface of the outer container; an inner sack, whose volume is reducible according to reduction of contents, inserted in the hollow interior of the outer container to be mounted, the inner sack having an opening for containing the contents; and a container cap, to which a valve assembly is disposed, fitted in an inner periphery of the opening of the inner sack and engaged with the bead portion of the outer container for constituting, together with the inner sack, a liquid container, wherein a lower end of the inner sack is not in contact with a bottom of the hollow interior of the outer container.

In another aspect of the invention, a method for manufacturing a double chamber aerosol container has the steps of: inserting a container cap, to which a valve assembly is disposed, in an inner periphery of an opening of an inner sack, whose volume is reducible according to reduction of contents, to fit the container cap at the opening, the inner sack and the container cap constituting a liquid container; inserting the inner sack in an outer container upon temporarily fitting the container cap to a bead portion of the outer container without immovably securing the container cap to the bead portion; coupling the outer container with a filling head for a propellant where a lower end of the inner sack is not in contact with a bottom of a hollow interior of the outer container; lifting the container cap upward from the bead portion to form a filling gap between the container cap and the bead portion; introducing the propellant into the outer container via the filling gap; securing the container cap and the outer container to each other by way of the opening of the inner sack upon immobilizing the container cap by clinching the container cap to the bead portion; and filling the contents within the inner sack by way of the valve assembly.

According to a preferred embodiment, the container cap is fitted immovably in the opening of the inner sack. The container cap is preferably fitted by, while the inner sack is suspended, frictional force not making the inner sack drop due to the weight of the inner sack. A communication gap for a propellant in a size of 0.01 to 1.00 mm may be formed between an inner peripheral surface of the bead portion and an outer peripheral surface of the inner sack.

To manufacture the double chamber aerosol container thus constituted, first, the container cap is inserted as to fit to the inner sack in which the contents are filled before the contents are filed in the sack. The container cap is fitted to the inner periphery of the opening of the outer container. This fitted state can be an immobilized state such as adherence or welding between the container cap and the inner sack or be made by coupling with fitting force of a degree that the inner sack does not drop from the container cap due to the weight of the inner where the inner sack is suspended to an outer periphery of the container cap. The container cap is formed with the valve assembly including a stem, a housing, and so on.

The inner sack thus connected to the container cap is then mounted within the outer container upon engagement with the bead portion of the outer container. In this state, the lower end of the inner sack is made in a size so as not to contact with the inner surface of the bottom of the outer container. The inner sack therefore avoids improper contact with the bead portion caused by contacts with the bottom of the outer container, so that the container cap and the inner sack can be surely mounted on the bead portion.

In case the container cap is thus mounted to the outer container, the container cap is not secured to but temporarily fitted to the outer container, and the contents are not yet filled in the inner sack. Accordingly, even if the lower wall of the outer container does not contact or support the lower end of the inner sack, the container cap adequately holds and engages the inner periphery of the opening of the inner sack. It may be done with frictional force that makes the inner sack not to drop by its weight in the condition that the inner sack is suspended.

In a case where force in a separating direction may be exerted to the inner sack and the container cap, such as, a case that many container caps coupled to respective inner sacks are placed in the same container, or that such a sack is mounted with high speed to the outer container by means of an automation machine, the container cap may preferably be immovably inserted and secured to the inner periphery of the opening of the inner sack.

As described above, the filling head is connected to the top of the container cap where the container cap coupled to the inner sack is temporarily fitted to the bead portion of the outer container, and the filling gap for the propellant is formed between the container cap or the inner sack and the bead portion by pulling the container cap and the inner sack upward.

After the propellant is filled in the outer container by way of the filling gap for the propellant, the container cap is clinched to the bead portion of the outer container, thereby sealing the outer container and making the outer container, the container cap, and the inner sack secured in a united body.

The contents are filled in the inner sack by a through-valve method by way of the valve assembly secured to the container cap.

This invention thus can make the inside of the inner sack not in contact with the open air since the container cap and the inner sack are in an engagement state before those are mounted within the outer container. The contents are filled by way of the valve assembly, and therefore, when filled in the inner sack, the contents can be filled without contacting with the open air and avoid overfilling. Thus, there will be no problem where contents easily oxidized or contents such as gel foams generating bubbles from increase of temperature due to contacts with the open air are filled. Because this invention allows the contents to be filled without contacting the open air, it is particularly favorable for medicines, cosmetics, foods, and so on, in which prevention of contamination is strongly demanded.

Coupling between the container cap and the bead portion is in a state forming a gap where the lower end of the inner sack is not in contact with the lower end of the outer container, and therefore, the inner sack never pushes up the container cap as to incline the container cap. The container cap and the inner sack can be surely fitted at the proper place with respect to the bead portion of the outer container, and the container cap and the outer container are surely secured by clinching the container cap to the bead portion after the propellant is filled, thereby preventing gases from leaking. Because the container cap and the inner sack are in the engagement relation before those are mounted in the outer container, those are easily handled, and the work productivity can become very high.

The contents to be filled in the inner sack are, as hair care products, hair sprays, hair treatments, hair shampoos, hair conditioners, acidic hair dyes, oxidizing two-agent type permanent hair dyes, color spray-decolorant, agents for permanently waving treatment, hair restorers, hair foams, hair tonics, sprays for correcting bad hair, fragrances for hair, and so on.

As cosmetics, exemplified are shaving creams, after-shave lotions, after-shave gels, perfumes and Eau de Colognes, facial cleansing agents, sunscreens, beauty washes, foundation creams, depilatories, decolorants, bath gels, toothpastes, skin care foams, and so on.

As deodorants and antiperspirants, exemplified are, e.g., antiperspirants, deodorants, body shampoos, etc. As other human body treatment goods, exemplified are muscular antiphlogistics, skin disease treatments, dermatophytosis medicines, insect repellents, cleaners, oral agents, salves, burning medicines, etc.

As insecticides, exemplified are, e.g., air-spray insecticides, insecticides for cockroach, insecticides for gardening, insecticides for ticks, pesticides for noxious insects, etc. As coating agents, exemplified are, e.g., paints for house, paints for automobile, undercoating agents, etc.

As cleaners, exemplified are glass cleaners for house, carpet cleaners, bath cleaners, floor and furniture cleaners, shoe and skin cleaners, wax cleaners, etc. As other goods for household, exemplified are, e.g., room deodorants, deodorants for toilet, waterproofing agents, starches for washing, herbicides, insecticides for clothes, flame proofing agents, fire extinguishers, antifungals, deodorants for garbage, etc.

As industrial use, exemplified are, e.g., lubricants, anticorrosives, adhesives, metal flaw detecting agents, mold-releasing agents, caulking agents, etc. As automobile use, exemplified are, e.g., defrosting agents, antifreezing or thawing agents, puncture repairers, engine cleaners, etc. As other uses, exemplified are, e.g., pet care goods, hobby goods, amusement goods, foods such as coffee, juices, creams, cheeses, etc.

DESCRIPTION OF PREFERRED EMBODIMENTS

Figure 1:
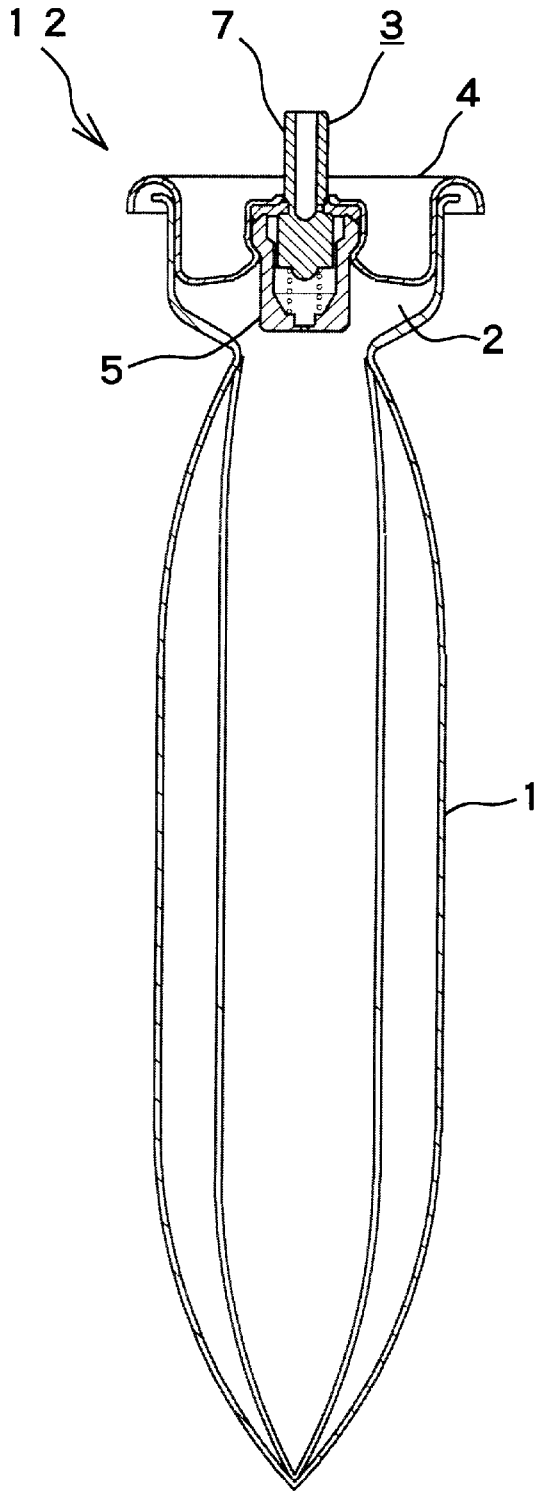
FIG. 1 is a cross section showing a container cap and an inner sack according to an embodiment of the invention where those are coupled.
Figure 2:
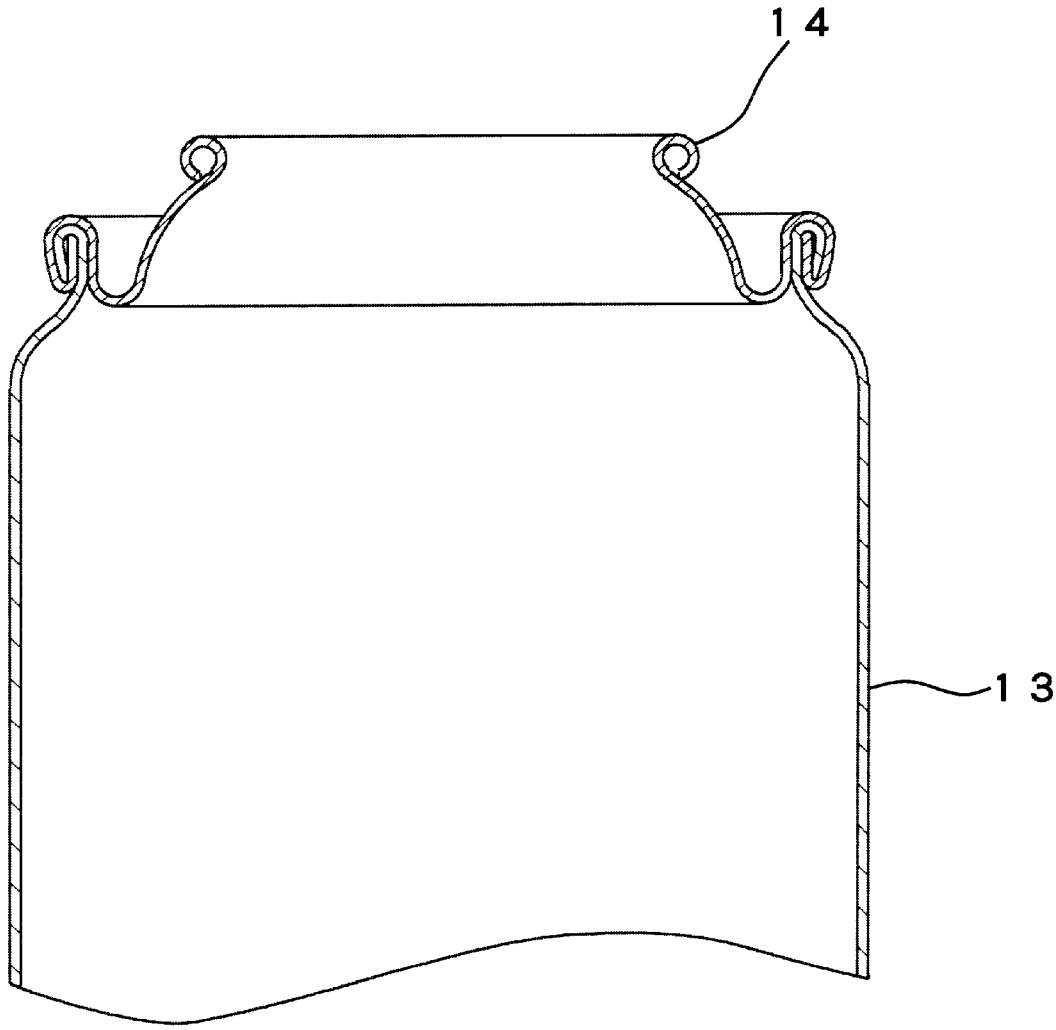
FIG. 2 is a cross section showing a part of an outer container according to the embodiment of the invention.

Referring to the drawings, a double chamber aerosol container and a method for manufacturing the aerosol container are described. Numeral 1 is an inner sack and is formed of a soft material so that the volume is reducible according to reduction of the contents filled therein or formed in a pleated shape. A container cap 4 to which a valve assembly 3 is disposed is inserted and secured to an inner periphery of an opening 2 of the inner sack 1 as shown in FIG. 1.

The container cap 4 and the inner sack 1 can be secured not to separate from each other by a method such as use of adhesive or welding. The inner sack 1 may be fitted to the container cap 4 by frictional force of a degree that the inner sack 1 does not fall by its weight from the container cap 4 where the inner sack 1 is suspended at an outer periphery of the container cap 4.

Figure 10:
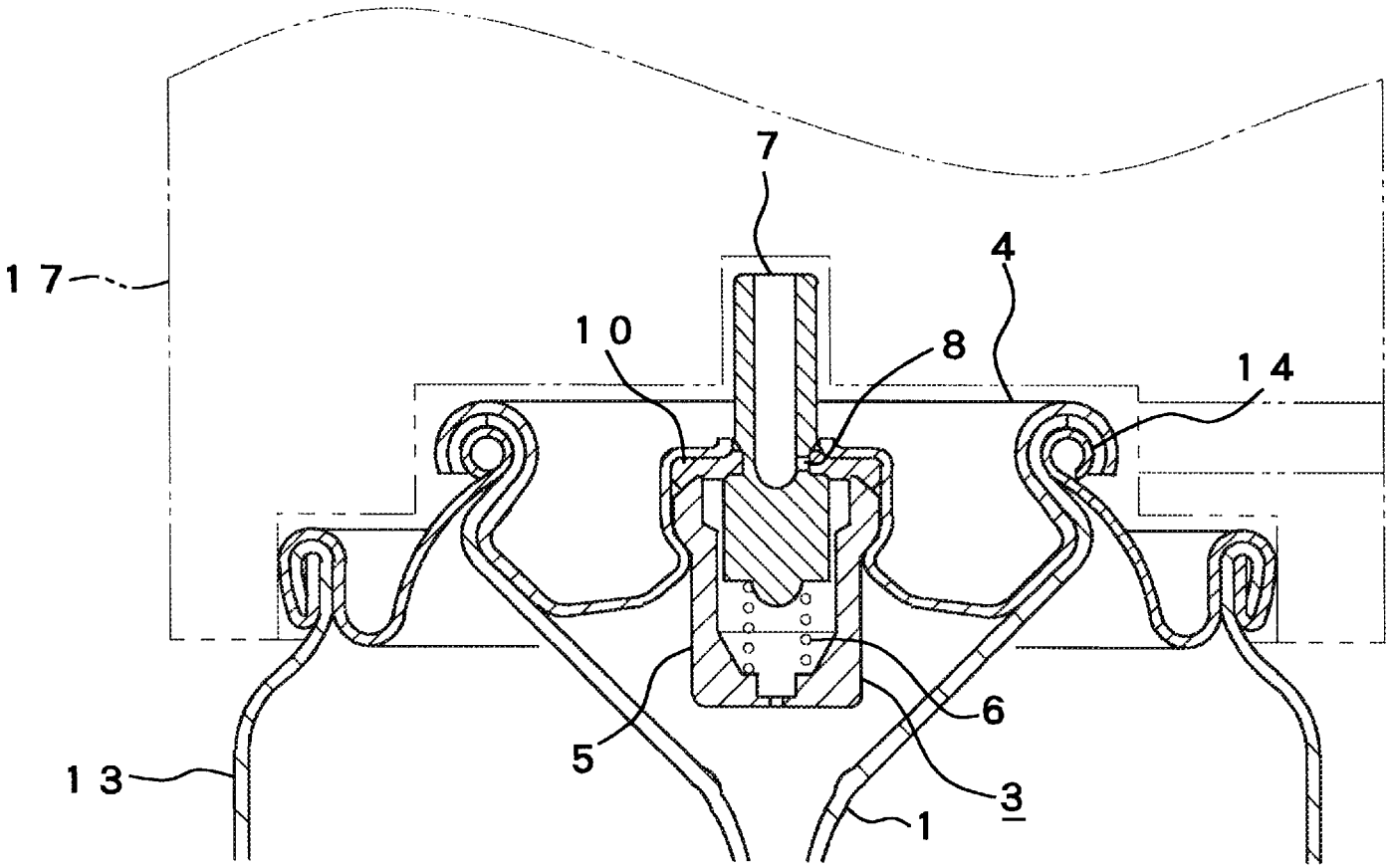
FIG. 10 is an enlarged cross section showing a portion of the container cap in FIG. 9.

The valve assembly 3 can be constituted of a known structure, and in this embodiment, as shown in FIG. 10, a housing 5 is secured at the center of the container cap 4, and a stem 7 that is urged outward by a coil spring 6 is inserted in this housing. Since an orifice 8 of the stem 7 is sealed with an inner peripheral surface of a ring-shaped gasket 10, the inside and outside of an outer container 13 are not in communication with each other unless the stem 7 is pressed, and therefore, the assembly 3 prevents contents 11 from spraying out. The inner sack 1 and the container cap 4 constitute a liquid container 12.

Figure 3:
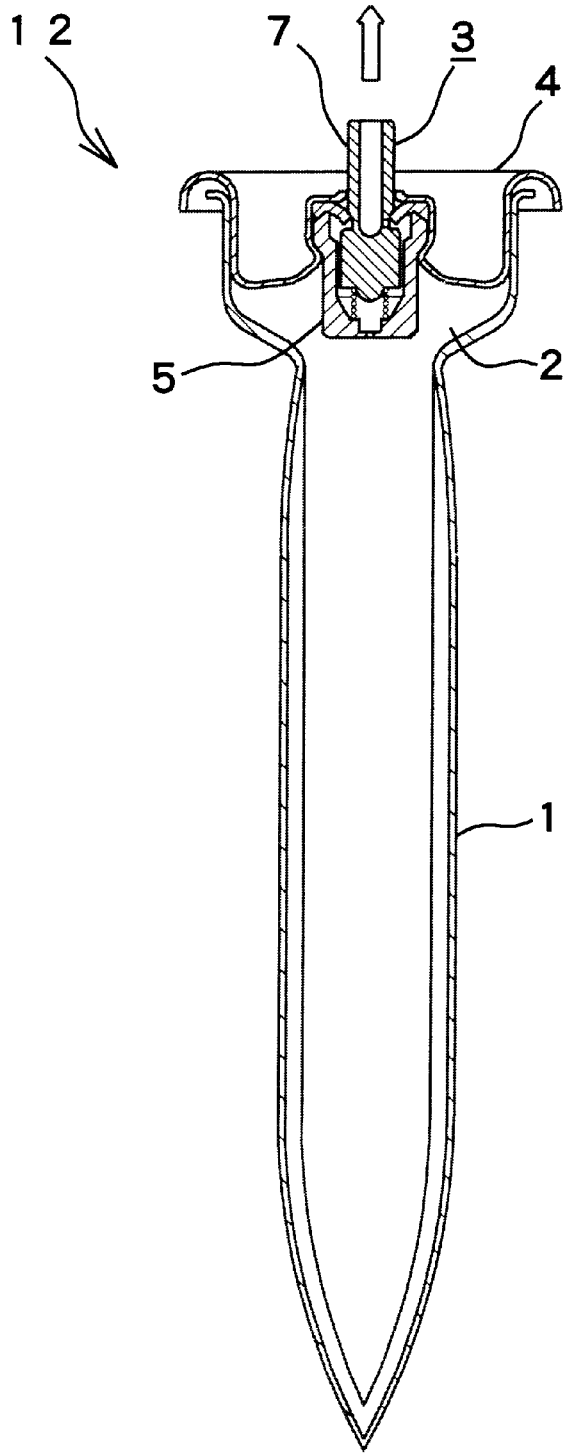
FIG. 3 is a cross section showing a state that air in the inner sack is discharged outside via a valve assembly.
Figure 4:
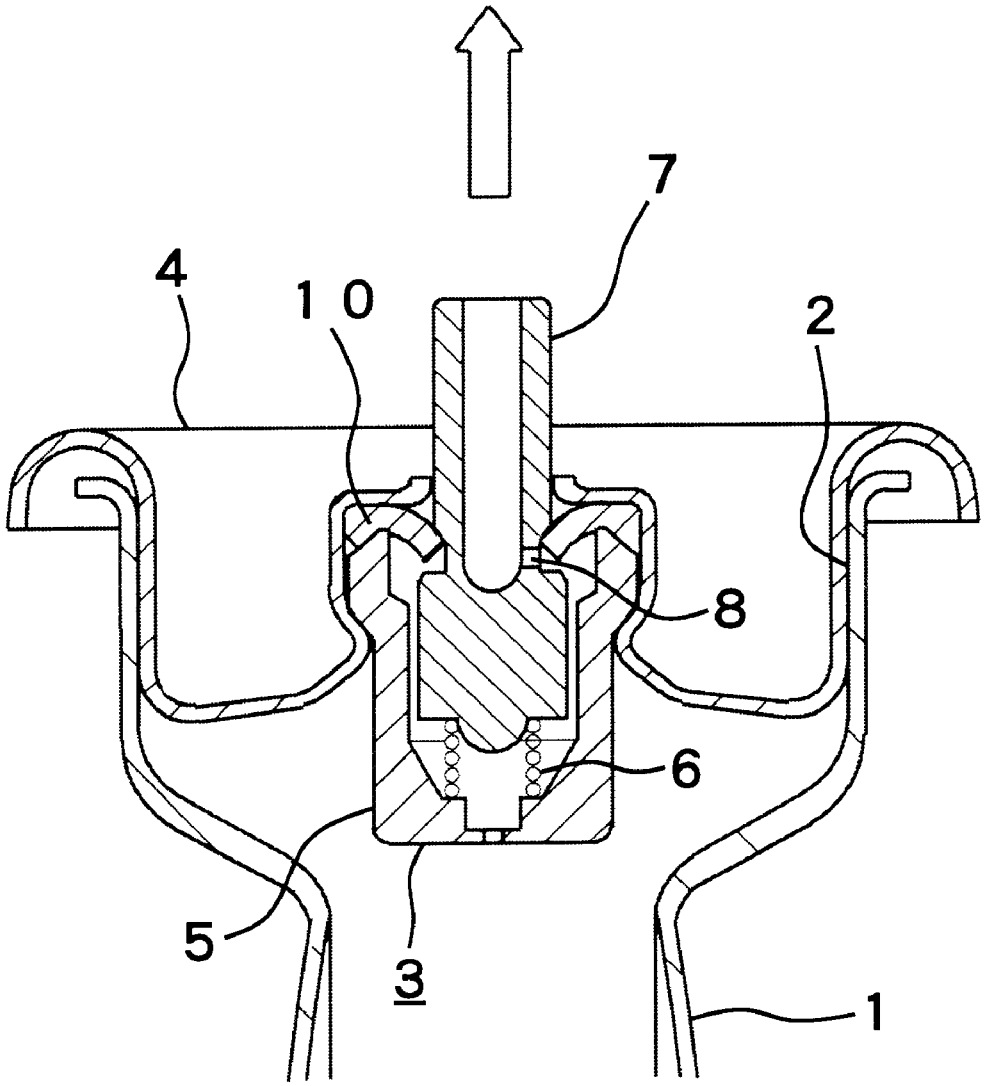
FIG. 4 is an enlarged cross section showing the container cap in FIG. 3.

Air in the inner sack 1 is vacuumed and discharged outside where the stem 7 of the valve assembly 3 is pressed and released as shown in FIGS. 3, 4 before the inner sack 1 is attached in the outer container 13 to remove the air in the inner sack 1. This discharge of the air in the inner sack 1 is not necessarily made, and it is enough that the air in the inner sack 1 of a considerable volume is discharged. The inner sack 1 is preferably vacuumed but not necessarily made. The inner sack 1 thus vacuumed is inserted within the outer container 13 in association with a bead portion 14. In case air in the inner sack 1 is discharged, an outer diameter of the inner sack 1 is made smaller than an inner diameter of the bead portion 14, so that the sack 1 is inserted in the outer container without causing any problem.

Figure 5:
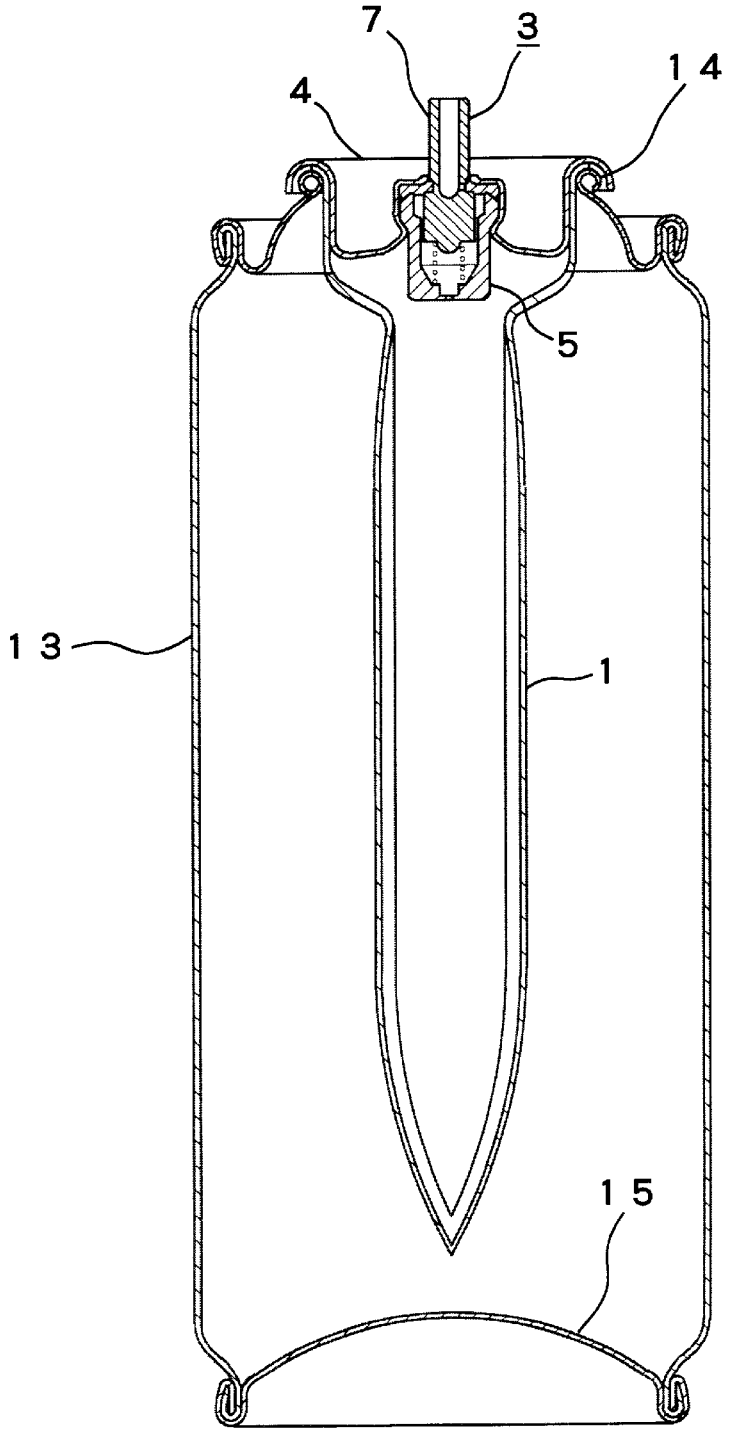
FIG. 5 is a cross section showing a state that the inner sack and the container cap are temporarily fitted to the outer container.

The container cap 4 and the inner sack 1 are mounted in the outer container 13 as shown in FIG. 5, and the container cap 4 is made in contact with the bead portion 14 of the outer container 13. This contact is so done, as shown in FIG. 5, that an upper end of the inner sack 1 is placed between the container cap 4 and the bead portion 14. The lower end of the inner sack 1 in this state is made not in contact with the bottom surface of the interior of the outer container 13. Since the lower end of the inner sack 1 is thus made not to contact with the inner surface of the bottom 15 of the outer container 13, the inner sack 1 is never pushed up or inclined due to contact with the bottom 15 of the outer container 13, so that the container cap 4 is surely made in contact with the bead portion 14 of the outer container 13.

Figure 7:
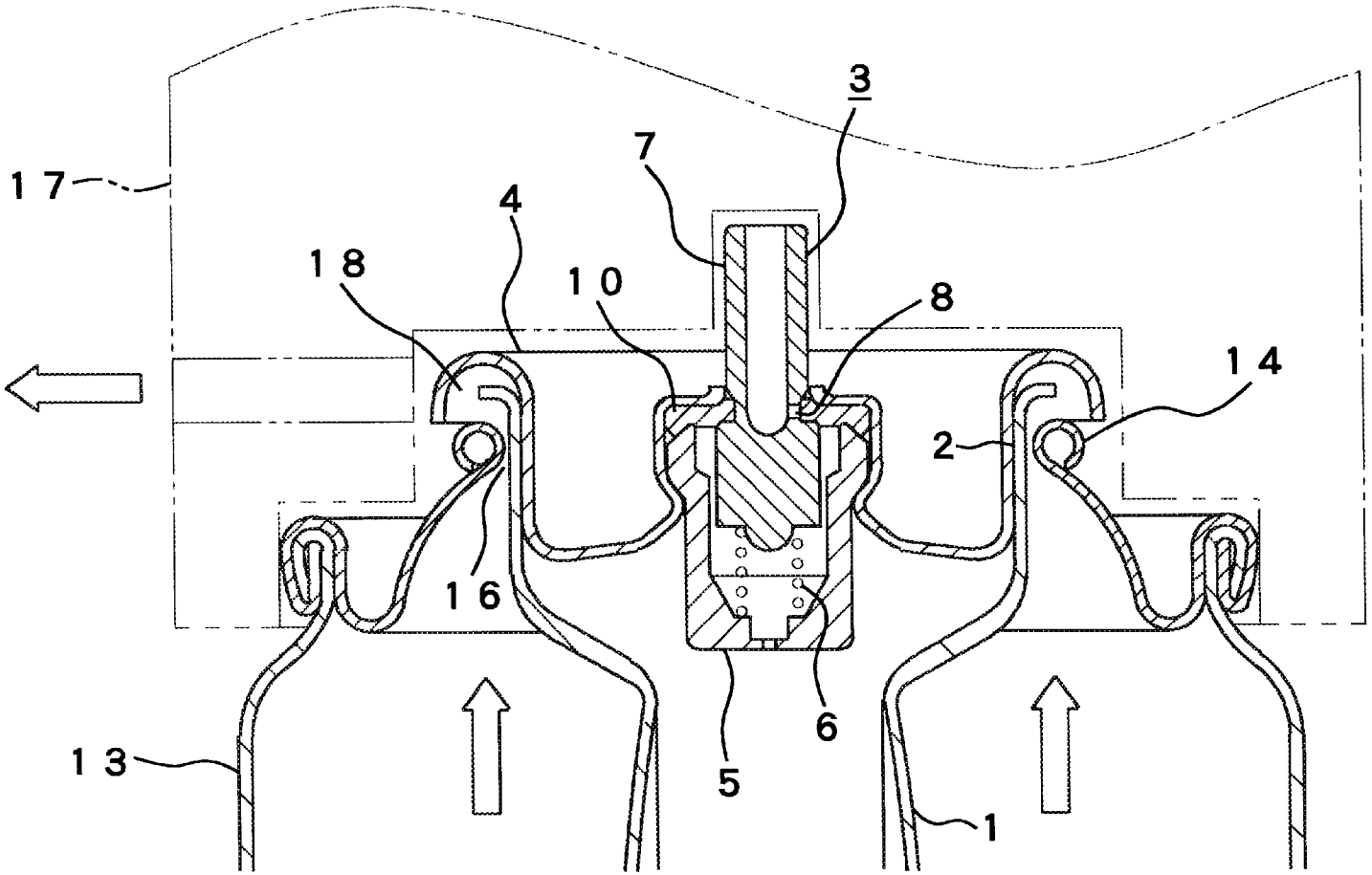
FIG. 7 is an enlarged cross section showing a portion of the container cap in FIG. 6.

In case the container cap 4 is mounted on the outer container 13, a communication gap 16 for propellant of 0.01 to 1.0 mm is formed as shown in FIG. 7 at a space between the outer periphery of the opening 2 of the inner sack 1 and the bead portion 14. In case the inner sack 1 is attached in the outer container 13, the container cap 4 and the outer container 13 are temporarily fitted without being secured to each other.

Figure 6:
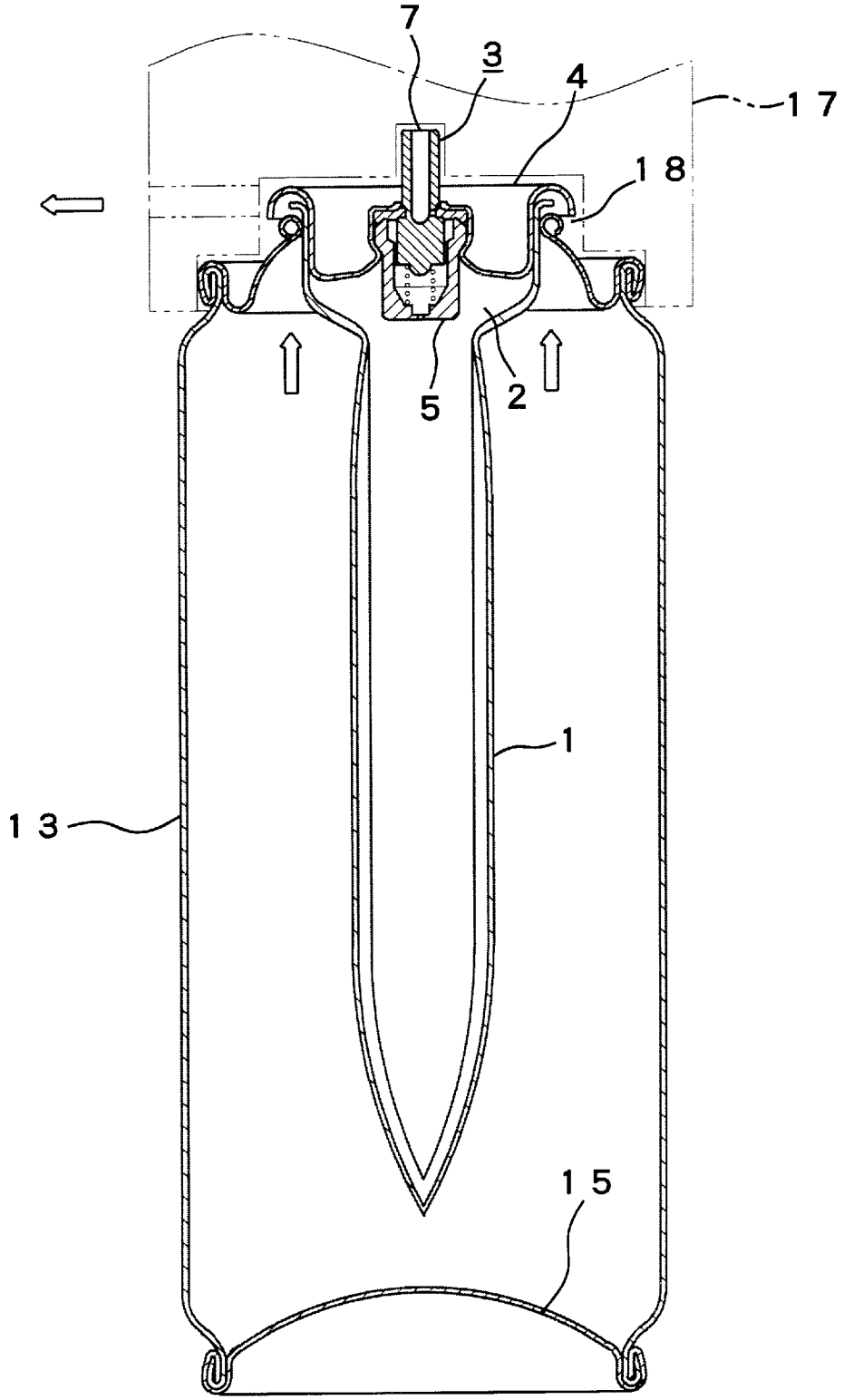
FIG. 6 is a cross section showing a state that a filling head for propellant is mounted on a top end of the outer container and the outer container is vacuumed.

The inner sack 1 is inserted thus in the outer container 13, and where the container cap 4 and the bead portion 14 are temporarily fitted to each other, as shown in FIG. 6, a filling head 17 is mounted on a top of the outer container 13, and by operation of the filling head 17, the container cap 4 is lifted upward. This can be made by vacuuming or by mechanical operation. Where the container cap 4 is thus suspended, a filling gap 18 for propellant is created between the bead portion 14 and the container cap 4. Air in the outer container 13 is removed outside by vacuuming through the filling gap 18 while the filling gap 18 is created.

Figure 8:
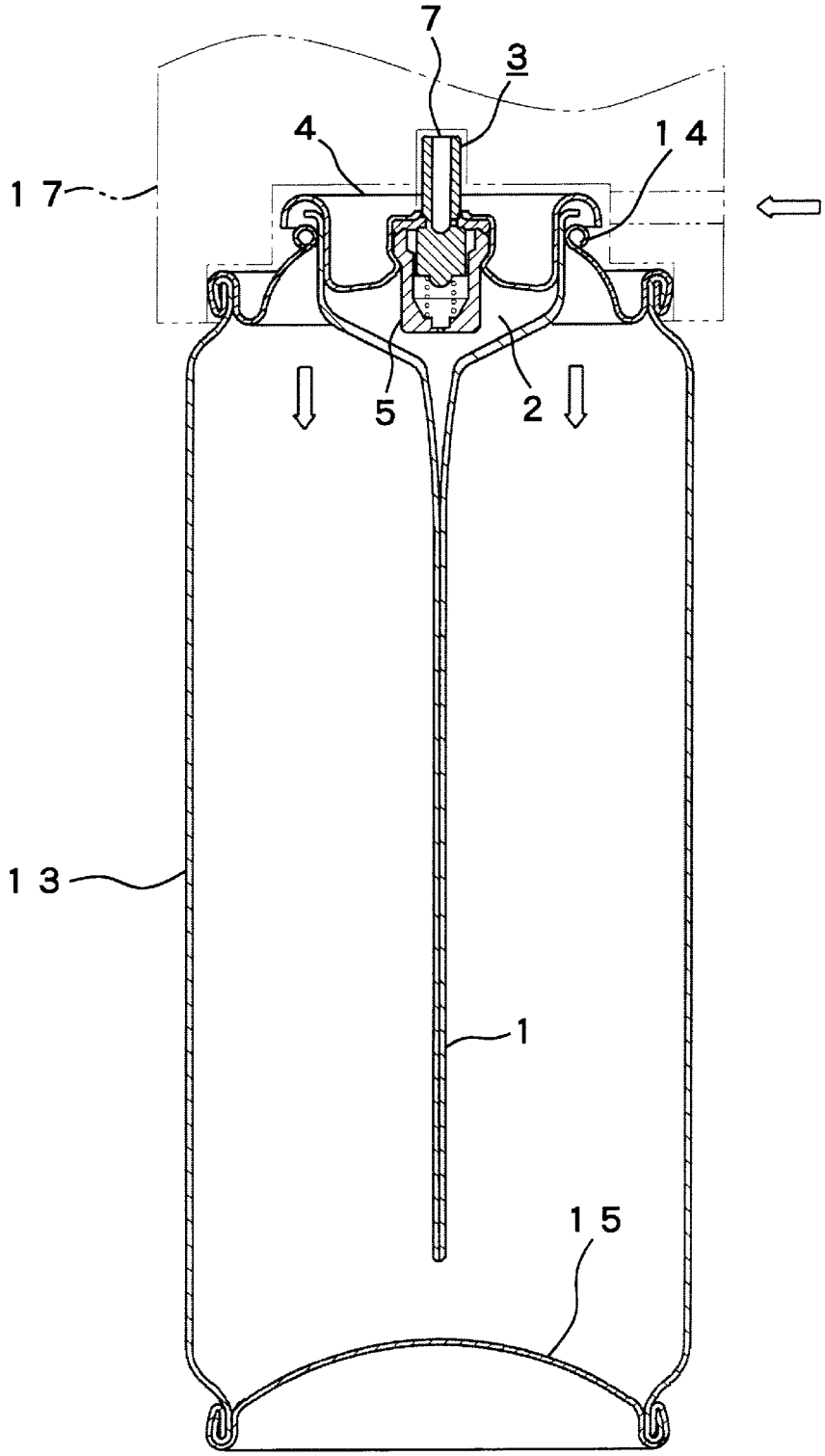
FIG. 8 is a cross section showing a state that the propellant is filled in the outer container.
Figure 9:
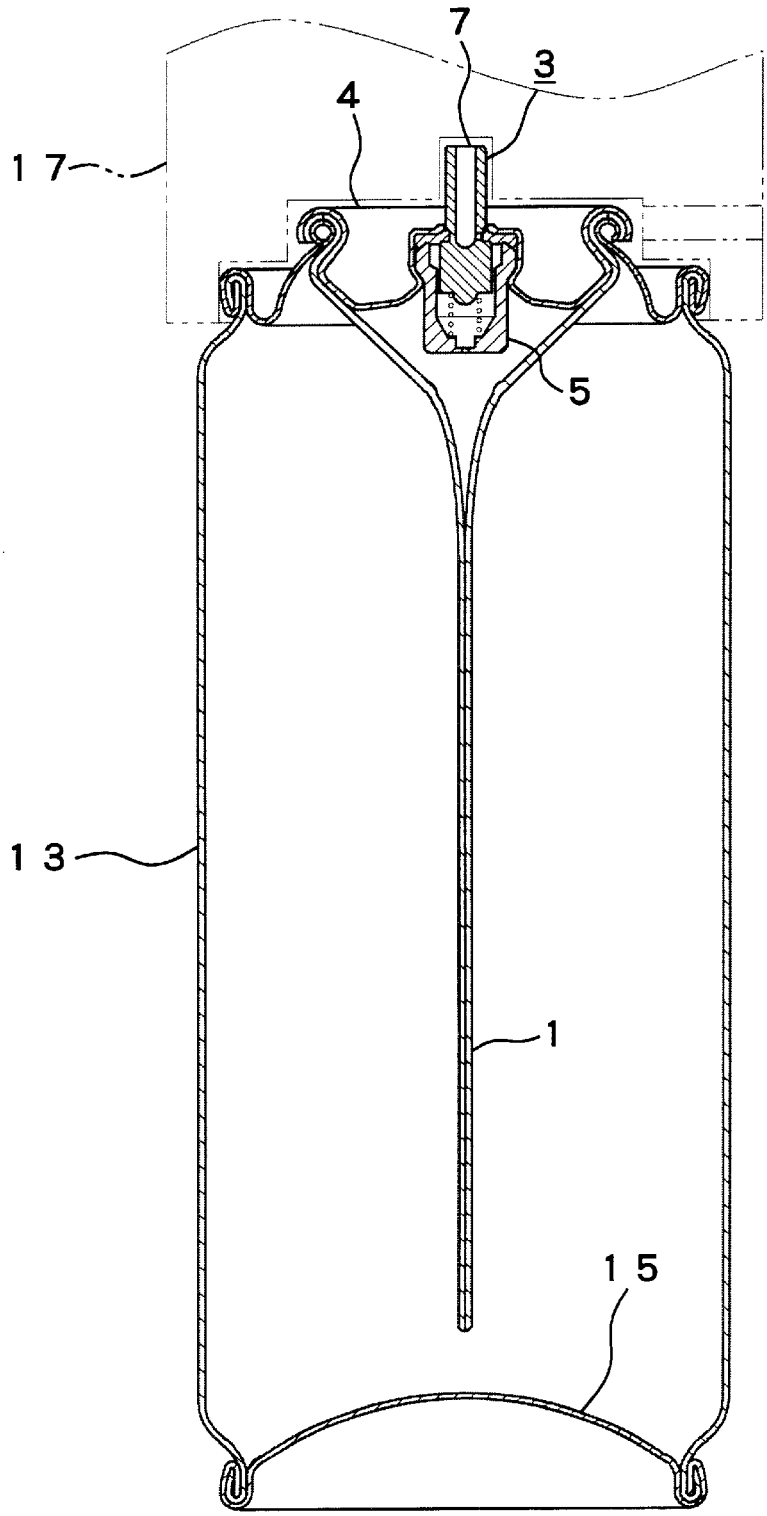
FIG. 9 is a cross section showing a state that the container cap is clinched to the outer container.

Subsequently, as shown in FIG. 8, the propellant such as nitrogen is filled with pressure in the outer container 13 via the filling gap 18 for propellant. By this filling of the propellant, the inner sack 1 surely enters in a contracted state as shown in FIG. 8. After this contraction, as shown in FIGS. 9, 10, the bead portion 14 of the outer container 13 and the container cap 4 are clinched to surely secure the container cap 4 to the outer container 13. In this secured state, the end of the opening of the inner sack 1 is placed between the container cap 4 and the bead portion 14, thereby serving as a packing for the inner sack 1.

Figure 11:
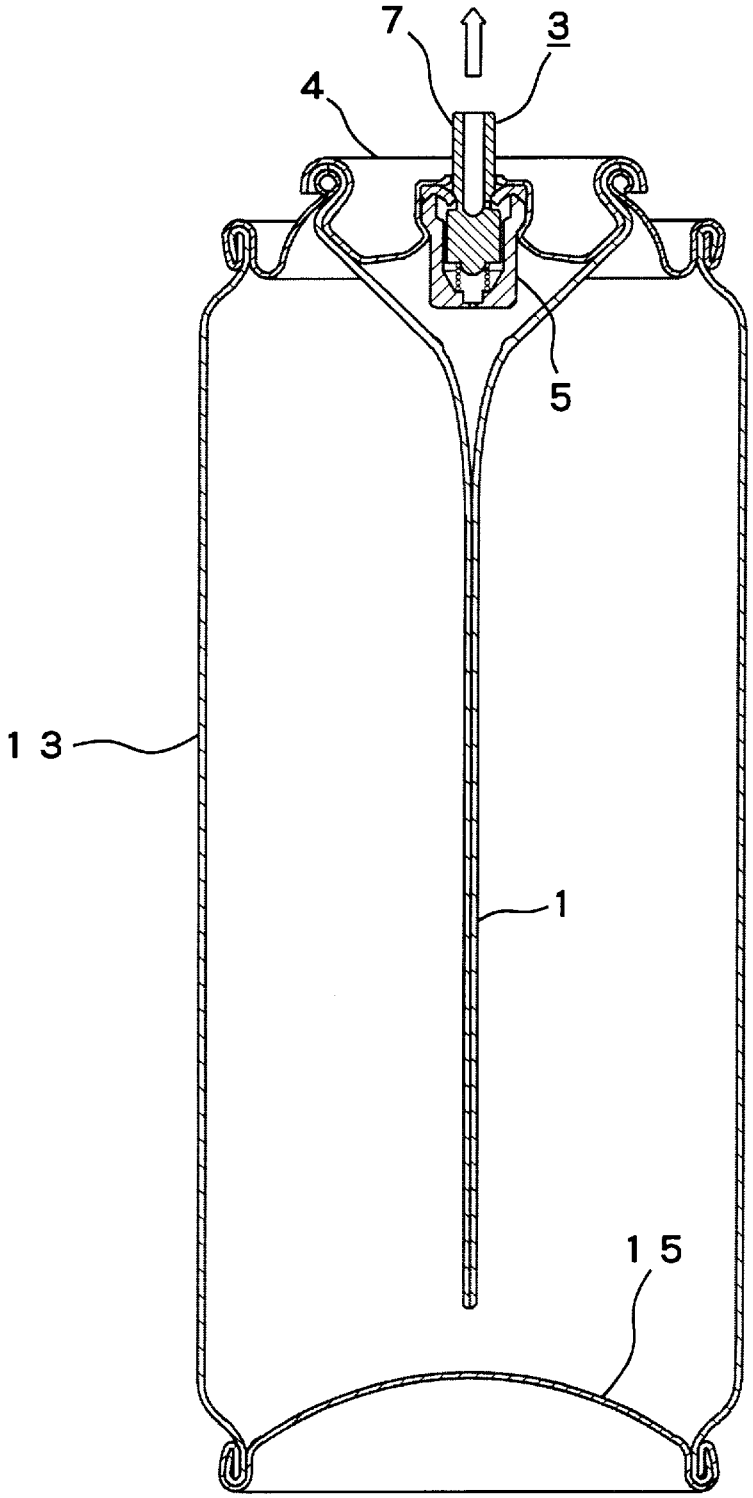
FIG. 11 is a cross section showing an examination state for pin holes in the inner sack.

After the container cap 4 is clinched, a pin hole examination is performed for finding pinholes or the like in the inner sack 1. This pin hole examination is made by measuring gas components drawn by vacuuming upon vacuuming the inner sack 1 where the stem 7 is pressed to open the valve assembly 3 as shown in FIG. 11. If any propellant is simultaneously withdrawn from the valve assembly 3, the inner sack 1 has some pinhole, and the product will be eliminated from this manufacturing process.

Figure 12:
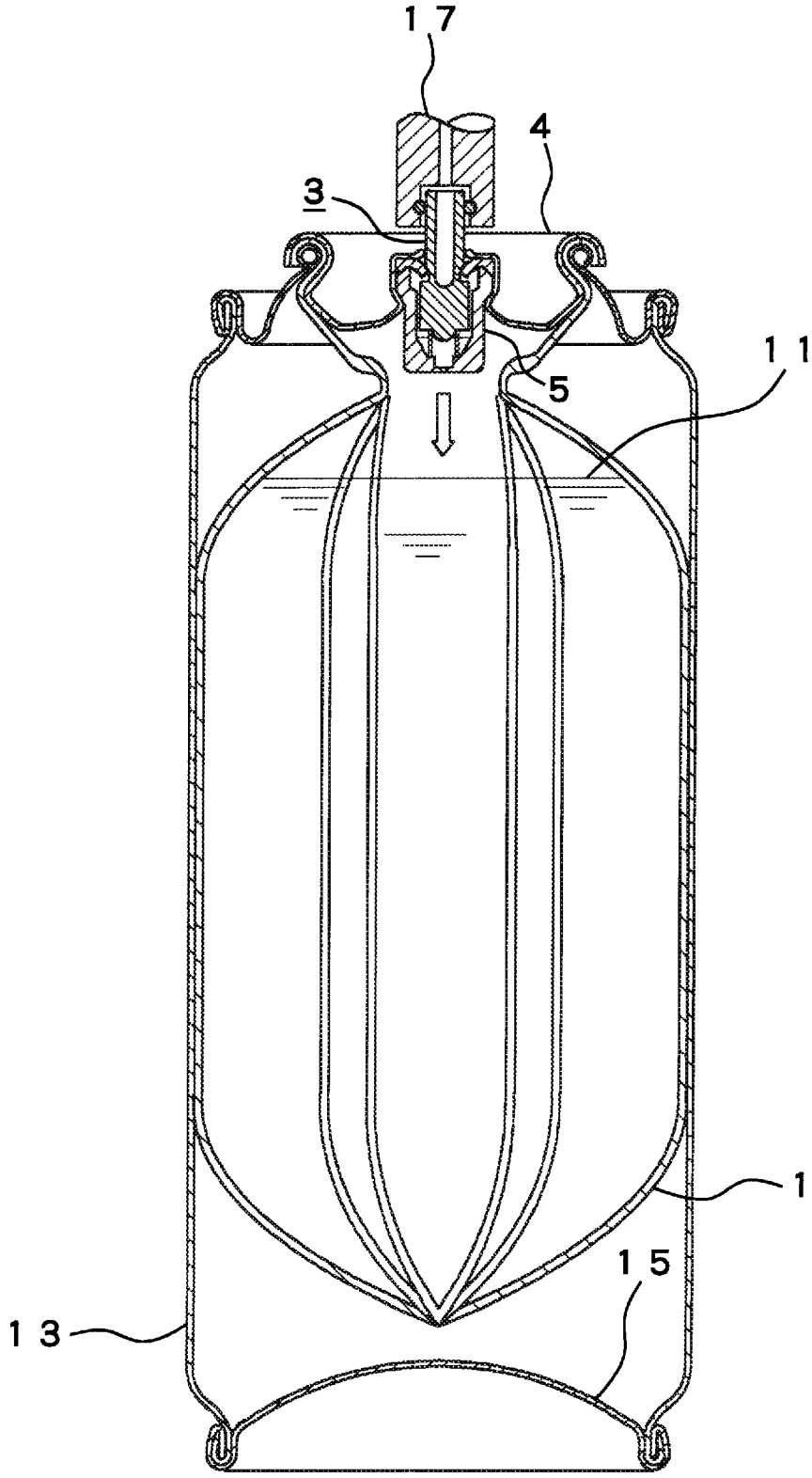
FIG. 12 is a cross section showing a state that contents are filled in the inner sack.

If no extraordinary matter is found in the inner sack 1 during this pin hole examination, as shown in FIG. 12, the filling head 17 for contents 11 is coupled to the valve assembly 3, and the contents 11 are filled in the inner sack 1 via the valve assembly 3. This filling allows the contents 11 not to contact with air because the inner sack 1 is held in a surely sealed state via the valve assembly 3. Therefore, there will be no problem even where a hair dye agent that may produce oxidation upon contacts with the air is filled in the inner sack 1 or where a gel foam using an isopentane or the like generating foams upon contacts with the air is filled. Filling of the contents 11 is completed where the contents 11 are filled in the inner sack 1 and where the pressures in the inner sack 1 and the outer container 13 are equalized.

The inner sack 1 increases its volume equally in a width direction by widening the pleat when the contents 11 are filled. The inner sack 1 is formed of a polyethylene resin, which prevents the filled contents 11 from leaking in the outer container 13 and the propellant from entering into the inner sack 1.

Where the outer container 13 thus manufactured is manipulated, the contents 11 are well sprayed out by pressure of the propellant exerted to the entire outer peripheral surface of the inner sack 1 where the contents 11 are sprayed. Because the inner sack 1 has the pleats, the inner sack 1 is stably contracted according to reduction of the contents 11 in association with pressure given by the propellant. Consequently, spraying can be continued constantly until the end of the spraying, and the contents 11 can be sprayed without any waste.

Although in the above embodiment the inner sack 1 is made of the polyethylene resin, it can be made of polypropylene resin, polyethyleneterephthalate resin, polyacrylonitrile resin, and the like. The inner sack 1 can be formed in a single layer structure using a single kind resin as described above, and an inner sack 1 of a multiple layer structure can be formed by overlaying multiple resins. For example, an ethylene-vinylalcohol copolymer is disposed on an outer surface of the polyethylene resin, and another polyethylene resin is disposed over the surface to form an inner sack 1 of a multiple layer structure. As another embodiment, a polyethyleneterephthalate resin is disposed on an outer surface of the polyethylene resin, and another polyethylene resin is disposed on the surface to form an inner sack 1 of another multiple layer structure. In any case of the above examples, the inner sack 1 is formed properly of a material having a durability against the contents and components of the propellant.

The followings are prescriptions of the respective contents 11 where hair care products, cosmetics, deodorants, antiperspirants, other products for human being, insecticides, and household products are filled in the above inner sack 1. The propellant filled in the outer container is a gas of one kind or a mixture gas of multiple kinds selected from compression gases such as nitrogen, carbonate gas, suboxide nitrogen, air, etc., and liquid gases such as liquid petroleum gas, and diethylether, etc.

As hair preparations, exemplified are a hair spray, a hair treatment, a tonic, and a hair-restorer.

| Hair Spray | |
|---|---|
| Acrylic resin alkanol amine liquid (30%) | 4.00 weight % |
| Polyoxyethylene oleyl ether | 0.01 weight % |
| Triethanol amine | 0.50 weight % |
| Perfume | 0.17 weight % |
| 99% denatured ethanol | 95.32 weight % |
| Total | 100.00 weight % |
| **Hair Treatment** | |
| Liquid paraffin | 1.50 weight % |
| Propylene glycol | 0.20 weight % |
| Methyl phenol polysiloxane | 0.10 weight % |
| Perfume | 0.20 weight % |

-continued

| | |
|---|---|
| 99% denatured ethanol | 98.00 weight % |
| Total | 100.00 weight % |
| **Hair tonic** | |
| Tocopherol acetate | 0.05 weight % |
| Polyoxyethylene setting castor oil (E.O 60) | 0.30 weight % |
| L-menthol | 0.28 weight % |
| d1 - camphor | 0.05 weight % |
| Tincture of pepper | 0.05 weight % |
| Lactic acid | 0.02 weight % |
| Perfume | 0.20 weight % |
| 95% denatured ethanol | 57.00 weight % |
| Refined water | 42.05 weight % |
| Total | 100.00 weight % |
| **Hair restorer** | |
| Salicylic acid | 0.30 weight % |
| Tocopherol acetate | 0.05 weight % |
| Essence of Japanese green gentian | 0.20 weight % |
| L-menthol | 0.05 weight % |
| Concentrated glycerol | 1.00 weight % |
| 95% denatured ethanol | 60.00 weight % |
| Refined water | 38.40 weight % |
| Total | 100.00 weight % |
| **Acidic hair dye (gel type)** | |
| Pentyl alcohol | 10.00 weight % |
| Oleic acid | 5.00 weight % |
| Lactic acid | 5.00 weight % |
| Hydroxyethylcellulose | 2.00 weight % |
| Polyethylene glycol | 7.00 weight % |
| Dinatrium edetic acid | 0.20 weight % |
| Hyaluronic acid | 0.05 weight % |
| Colorant | 0.50 weight % |
| Dye | 0.10 weight % |
| 95% denatured ethanol | 10.00 weight % |
| Refined water | 60.15 weight % |
| Total | 100.00 weight % |

As cosmetics, exemplified are prescriptions of Eau de Cologne, sunscreen, shaving cream, beauty wash, after-shave lotion, facial mask agent, and facial cleansing agent.

| Eau de Cologne | |
|---|---|
| Dimethyl polysiloxane | 0.70 weight % |
| POE glycerol triisostearate | 1.00 weight % |
| Perfume | 2.00 weight % |
| Polyoxyethylene setting castor oil (E.O 60) | 1.00 weight % |
| Refined water | 35.00 weight % |
| 95% denatured ethanol | 60.30 weight % |
| Total | 100.00 weight % |
| **Sunscreen** | |
| Cetyl octanate | 30.00 weight % |
| Benzophenone-3 | 3.00 weight % |
| Tocopherol acetate | 0.10 weight % |
| Octyl methoxycinnamate | 6.00 weight % |
| Mineral Oil | 60.90 weight % |
| Total | 100.00 weight % |
| **Shaving cream (shave gel later foaming)** | |
| Palmitic Acid | 10.00 weight % |
| Dibuthyl hydroxytoluene | 0.10 weight % |
| Oleyl alchol | 1.00 weight % |
| Glycerol | 5.00 weight % |

-continued

| | |
|---|---|
| Sorbitol liquid (70%) | 5.00 weight % |
| Hydroxyethylcellulose | 0.50 weight % |
| Triethanolamine | 6.50 weight % |
| Preservatives | 0.20 weight % |
| Dye (1% solution) | 0.05 weight % |
| Isopentane / isobutane 95/5 | 0.35 weight % |
| Refined water | 68.15 weight % |
| Total | 100.00 weight % |
| Beauty wash | |
| Citric acid | 0.10 weight % |
| Zinc paraphenol sulfonic acid | 0.20 weight % |
| Sorbitol liquid (70%) | 0.15 weight % |
| Glycerol | 0.10 weight % |
| Polyoxyethylene setting castor oil (E.O 60) | 0.50 weight % |
| Preservatives | 0.20 weight % |
| Perfume | 0.10 weight % |
| 95% denatured ethanol | 1.50 weight % |
| Refined water | 97.15 weight % |
| Total | 100.00 weight % |
| After-shave (gel) | |
| Carboxyvinyl polymer | 0.25 weight % |
| Isopropylmethylphenol | 0.30 weight % |
| Triethanolamine | 2.50 weight % |
| Perfume | 0.10 weight % |
| Allantoin | 0.10 weight %. |
| 1, 3 butylene glycol | 1.50 weight % |
| Preservatives | 0.12 weight % |
| 95% denatured ethanol | 15.00 weight % |
| Refined water | 80.13 weight % |
| Total | 100.00 weight % |
| Facial mask agent | |
| Polyvinyl alcohol | 15.00 weight % |
| Carboxymethylcellulose | 5.00 weight % |
| Polypropylene glycol | 3.00 weight % |
| Perfume | 0.10 weight % |
| Preservatives | 0.20 weight % |
| 95% denatured ethanol | 10.00 weight % |
| Refined water | 66.70 weight % |
| Total | 100.00 weight % |
| Facial cleansing agent | |
| Polyethylene glycol | 0.30 weight % |
| Perfume | 0.20 weight % |
| Carboxyvinyl polymer | 2.00 weight % |
| Cocoyl amide propyldimethyl glycine | 20.00 weight % |
| Diethanolamide coconut oil fatty acid | 2.00 weight % |
| Citrus Acid | 0.10 weight % |
| Preservatives | 0.20 weight % |
| Dye (1% solution) | 0.05 weight % |
| 95% denatured ethanol | 0.95 weight % |
| Refined water | 74.20 weight % |
| Total | 100.00 weight % |

The following example is a prescription of an antiperspirant-deodorant.

| Antiperspirant - Deodorant | |
|---|---|
| Dipropylene glycol | 4.00 weight % |
| Tetrahydropropylethylenediamine | 0.20 weight % |
| Zinc phenol sulfonic acid | 2.00 weight % |
| Perfume | 0.10 weight % |
| Citrus acid | 0.40 weight % |
| Isopropylmethylphenol | 0.20 weight % |

-continued

| | |
|---|---|
| 95% denatured ethanol | 32.00 weight % |
| Refined water | 61.10 weight% |
| Total | 100.00 weight % |

The following examples are prescriptions of a muscular antiphlogistic, and an insect repellent as other body treatment products.

| Muscular antiphlogistic | |
|---|---|
| L-menthol | 3.00 weight % |
| Methyl salicylate | 2.70 weight % |
| Tocopherol acetate | 0.20 weight % |
| 99% denatured ethanol | 94.10 weight % |
| Total | 100.00 weight % |
| Insect repellent | |
| N,N-diethyl-m-toluamide | 4.00 weight % |
| Di-N-propyl-isocinchomeronate | 1.00 weight % |
| N-(2-ethyl hexyl)-bicyclo 2.2.1-hepta-5-en- 2.3-dicarboxyimide | 2.00 weight % |
| Polyoxyethylene glycol #400 | 1.50 weight % |
| 99% denatured ethanol | 91.50 weight % |
| Total | 100.00 weight % |

The following examples are prescriptions of an insecticide for cockroach and an insecticide for gardening.

| Insecticide for cockroach | |
|---|---|
| o, o- dimethyl -o- (3-methyl-4-nitrophenyl) thiophosphate | 1.25 weight % |
| Piperonyl butoxide | 1.95 weight % |
| Perfume | 0.01 weight % |
| Kerosine | 96.79 weight % |
| Total | 100.00 weight % |
| Insecticide for gardening | |
| (1,3,4,5,6,7 - hexahydro - 1,3 dioxo - 2 - isoindolyl) methyl-d1 -cis/trans-chrysanthemate | 0.20 weight % |
| Polyoxyalkyl phosphate | 0.20 weight % |
| Isopropyl alcohol | 4.00 weight % |
| Refined water | 95.60 weight % |
| Total | 100.00 weight % |

The following examples are prescriptions of a deodorant for garbage and a waterproofing spray as household products.

| Deodorant for garbage | |
|---|---|
| Lauric methacrylate | 2.00 weight % |
| Isopropyl methylphenol | 0.20 weight % |
| Hinokitiol | 0.01 weight % |
| Dipropylene glycol | 0.90 weight % |
| Perfume | 1.00 weight % |
| 99% denatured ethanol | 95.89 weight % |
| Total | 100.00 weight % |

-continued

| Waterproofing spray | |
|---|---|
| Fluororesin | 1.20 weight % |
| Methyl polysiloxane | 2.50 weight % |
| Hexylene glycol | 5.00 weight % |
| 99% denatured ethanol | 91.30 weight % |
| Total | 100.00 weight % |

Since this invention is thus constituted, the contents in the inner sack are never in contact with the open air, and the contents are surely filled in the inner sack where the air is cut off during the manufacturing process. Therefore, even if the contents filled in the inner sack are readily oxidized, or are medicines, cosmetics, foods, and so on, which are readily subject to contamination in contact with the open air, or are materials that generate bubbles by temperature increase due to contacts with the open air, the contents can be surely filled without being deteriorated.

Because the inner sack is set such that the lower end of the inner sack is not in contact with the bottom of the outer container, the container cap is surely engaged with the bead portion, thereby preventing the sealing from breaking due to inclination of the bead portion.

Since the inner sack and the container cap enter in an engagement relation before those are mounted in the outer container, the inner sack is readily set in the outer container during the manufacturing process and renders manufacturing productive and flawless.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A method for manufacturing a double chamber aerosol container comprising the steps of:

inserting a container cap having a valve assembly in an inner periphery of an opening of an expandable inner sack and fitting the container cap to the inner sack at the opening, the inner sack and the container cap constituting a liquid container;

inserting the inner sack suspended from the container cap in an outer container and temporarily fitting the container cap to a bead portion of the outer container without permanently securing the container cap to the bead portion where a lower end of the inner sack does not contact a bottom of a hollow interior of the outer container;

coupling the outer container with a filling head for a propellant:

lifting the container cap with the inner sack attached thereto upward from the bead portion to form a filling gap between the inner sack attached to the container cap and the bead portion;

introducing the propellant into a space between the outer container and the inner sack via the filling gap;

securing the container cap and the outer container to each other together with the inner sack therebetween by clinching the container cap to the bead portion; and filling contents within the inner sack by way of the valve assembly.

2. The method according to claim 1, wherein the container cap is fitted immovably in the opening of the inner sack.

3. The method according to claim 1, wherein the container cap is fitted with the inner sack so that the inner sack suspending from the container cap does not drop due to weight of the inner sack.

4. The method according to claim 1, wherein the filling gap for a propellant in a size of 0.01 to 1.00 mm is formed between an inner peripheral surface of the bead portion and an outer peripheral surface of the inner sack.

* * * * *